US011242627B2

(12) United States Patent
Yamauchi et al.

(10) Patent No.: US 11,242,627 B2
(45) Date of Patent: Feb. 8, 2022

(54) WATER INJECTION APPARATUS FOR WATER JET LOOM

(71) Applicant: KABUSHIKI KAISHA TOYOTA JIDOSHOKKI, Kariya (JP)

(72) Inventors: Yasushi Yamauchi, Aichi-ken (JP); Koichi Tsujimoto, Aichi-ken (JP); Kouichi Hattori, Aichi-ken (JP); Kenji Sumiya, Aichi-ken (JP); Taijirou Okuda, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 80 days.

(21) Appl. No.: 16/238,975

(22) Filed: Jan. 3, 2019

(65) Prior Publication Data

US 2019/0233987 A1 Aug. 1, 2019

(30) Foreign Application Priority Data

Jan. 31, 2018 (JP) ..... JP2018-014917

(51) Int. Cl.
*D03D 47/32* (2006.01)
*B05B 1/00* (2006.01)

(52) U.S. Cl.
CPC ..... *D03D 47/32* (2013.01); *B05B 1/00* (2013.01)

(58) Field of Classification Search
CPC ..... D03D 47/32; B05B 1/00
See application file for complete search history.

(56) References Cited

U.S. PATENT DOCUMENTS 4,121,626 A * 10/1978 Brown ..... D03D 47/32 139/435.1
5,271,062 A 12/1993 Sugita et al.

FOREIGN PATENT DOCUMENTS

| | | | |
|---|---|---|---|
| JP | 63-177975 U | | 11/1988 |
| JP | 03-279446 A | | 12/1991 |
| JP | 04-296897 A | | 10/1992 |
| JP | 05-163637 A | | 6/1993 |
| JP | 8-92844 A | | 4/1996 |
| JP | 11-294711 A | | 10/1999 |
| JP | 3404920 B2 | * | 5/2003 |

OTHER PUBLICATIONS

Office Action dated Feb. 13, 2020 in Korean Application No. 10-2019-0010841.

* cited by examiner

*Primary Examiner* — Khoa D Huynh
*Assistant Examiner* — Erick I Lopez
(74) *Attorney, Agent, or Firm* — Sughrue Mion, PLLC

(57) ABSTRACT

A water injection apparatus for a water jet loom, includes a weft insertion nozzle for weft insertion of a weft yarn by injection water, a weft insertion pump pumping water into the weft insertion nozzle, a water storage tank storing water introduced into the weft insertion pump, and a suction pipe passing water from the water storage tank into the weft insertion pump. The water injection apparatus includes an auxiliary water supply unit that is provided separately from the weft insertion pump and can supply water to the suction pipe. At least when the weft insertion pump sucks water, the auxiliary water supply unit supplies water to the suction pipe.

4 Claims, 5 Drawing Sheets

PATTERN A: WATER SUPPLY 0 - 360 degrees
(CORRESPONDING TO FIRST EMBODIMENT)

PATTERN B: WATER SUPPLY 20 - 250 degrees

PATTERN C: WATER SUPPLY 80 - 250 degrees

PATTERN D: NO WATER SUPPLY
(CORRESPONDING TO COMPARATIVE EXAMPLE)

WATER INJECTION APPARATUS FOR WATER JET LOOM

BACKGROUND ART

The present disclosure relates to a water injection apparatus for a water jet loom.

Japanese Patent Application Publication No. H03-279446 discloses a loom equipped with a cover made of a noise insulating material (hereinafter referred to as the noise insulating cover). The noise insulating cover hermetically closes the weaving parts of the loom that mainly cause noise, so that the noise insulating cover can effectively reduce noise when the loom operates.

Since the noise insulating cover hermetically closes the weaving parts of the loom in the above Publication, the noise insulating cover needs removing from the base of the loom and mounting on the base of the loom when adjustments such as mounting the noise insulating cover on the base of the loom and setting a weaving condition of the loom, are required to be performed in the base of the loom. Water jet looms are required to operate at a higher speed. Efforts have been made for operating the water jet looms at a higher speed. However, as the rotational speed of a water jet loom increases, noise from the weft insertion pump of the water jet loom becomes large. Since cavitation occurs in the weft insertion pump of the water jet loom when the water jet loom operates at a high rotational speed, noise becomes large. Specifically, when water is sucked by the weft insertion pump, bubbles occur. When the water is discharged, the bubbles collapse, so that large noise generates.

The present disclosure, which has been made in view of the above problems, is directed to providing a water injection apparatus for a water jet loom to reduce noise during a weaving operation without a noise insulating cover.

SUMMARY

In accordance with an aspect of the present disclosure, there is provided a water injection apparatus for a water jet loom, including a weft insertion nozzle for weft insertion of a weft yarn by injection water, a weft insertion pump pumping water into the weft insertion nozzle, a water storage tank storing water introduced into the weft insertion pump, and a suction pipe passing water from the water storage tank into the weft insertion pump. The water injection apparatus includes an auxiliary water supply unit that is provided separately from the weft insertion pump and can supply water to the suction pipe. At least when the weft insertion pump sucks water, the auxiliary water supply unit supplies water to the suction pipe.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure together with objects and advantages thereof, may best be understood by reference to the following description of the embodiments together with the accompanying drawings in which.

DETAILED DESCRIPTION OF THE EMBODIMENTS

First Embodiment

Figure 1:
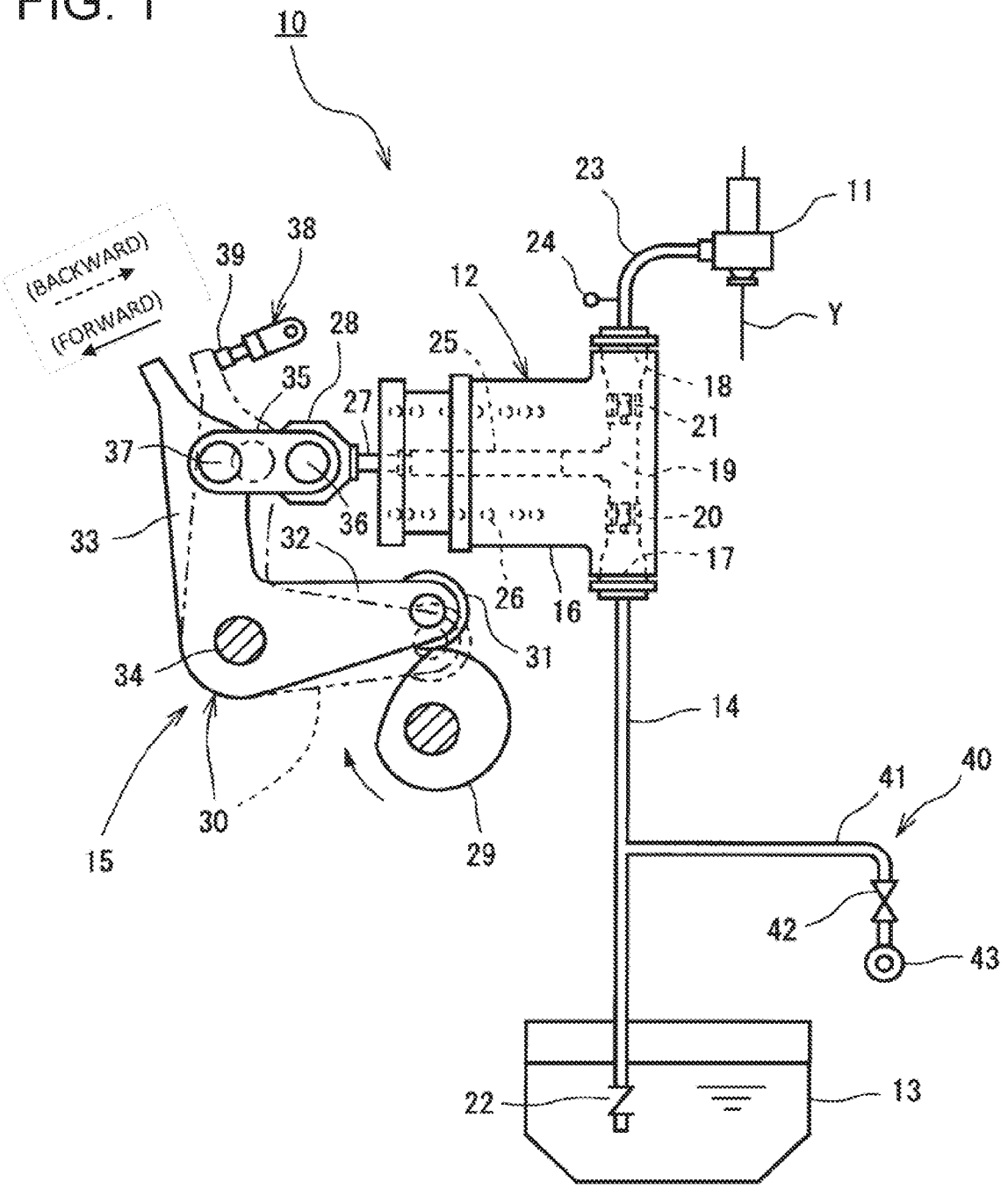
FIG. 1 is a schematic view showing a water injection apparatus for a water jet loom; according to a first embodiment of the present disclosure.

The following will describe a water injection apparatus for a water jet loom (hereinafter referred to as the water injection apparatus), according to a first embodiment of the present disclosure with reference to the drawings. Referring to FIG. 1, a water injection apparatus 10 includes a weft insertion nozzle 11 for weft insertion of a weft yarn Y by injection water, a weft insertion pump 12 pumping water into the weft insertion nozzle 11, a water storage tank 13 storing water introduced into the weft insertion pump 12, and a suction pipe 14 passing water from the water storage tank 13 into the weft insertion pump 12. The water injection apparatus 10 includes a cam unit 15 connected to the weft insertion pump 12 to operate the weft insertion pump 12.

The weft insertion pump 12 includes a pump housing 16 fixed to a frame (not shown in the drawing) of the water jet loom. The pump housing 16 has therein a suction port 17 introducing water and a discharge port 18 discharging compressed water. A water storage chamber 19 is formed between the suction port 17 and the discharge port 18 of the pump housing 16. A check valve 20 is provided between the suction port 17 and the water storage chamber 19. A check valve 21 is provided between the water storage chamber 19 and the discharge port 18. Accordingly, water introduced from the suction port 17 into the water storage chamber 19 is not discharged from the suction port 17. No compressed water discharged from the discharge port 18 flows reversely into the water storage chamber 19.

One end of the suction pipe 14 is connected to the suction port 17. The other end of the suction pipe 14 communicates with the water storage tank 13. The suction pipe 14 serves as a main water supply passage through which water is supplied from the water storage tank 13 into the weft insertion pump 12. The water storage tank 13 is a closed tank and connected to a water source (not shown in the drawing). A check valve 22 is provided in the suction pipe 14 and located in the water storage tank 13. One end of the discharge pipe 23 is connected to the discharge port 18. The other end of the discharge pipe 23 communicates with the weft insertion nozzle 11. A pressure sensor 24 is provided in the discharge pipe 23 and detects pressure of water discharged from the weft insertion pump 12. The pressure sensor 24 is connected to a controller (not shown in the drawing) that controls parts of the water jet loom.

The pump housing 16 accommodates therein a plunger 25 that is movable reciprocally in the pump housing 16. The pump housing 16 holds the plunger 25 in the center thereof.

The direction in which the plunger 25 moves away from the water storage chamber 19 is a forward direction. The direction in which the plunger 25 moves close to the water storage chamber 19 is a backward direction. The pump housing 16 accommodates therein a coil spring 26. The coil spring 26 is a compression coil spring and urges the plunger 25 in the forward direction.

One end surface of the plunger 25 faces the water storage chamber 19. The volume of the water storage chamber 19 varies by the reciprocal movement of the plunger 25. The other end surface of the plunger 25 is connected to one end of a connecting shaft 27 that is coaxial with the plunger 25. A connector 28 is provided with the other end of the connecting shaft 27 and connected to the cam unit 15.

The following will describe the function of the cam unit 15. The cam unit 15 includes a cam 29 that rotates at a constant angular speed in synchronization with drive and a cam lever 30 rotated by the rotation of the cam 29. The cam lever 30 has an arm 32 located on the side of the cam 29 (hereinafter referred to as the arm 32), bent in a L-shape, extending toward the weft insertion pump 12, and having a cam follower 31 and an arm 33 located on the side of a link 35 (hereinafter referred to as the arm 33) described later and extending substantially perpendicularly to the direction in which the arm 32 extends. A rotary shaft 34 is provided in the center of the cam lever 30. The cam lever 30 is pivotable on the rotary shaft 34. The cam follower 31 of the arm 32 is attachable and detachable with the cam 29 that rotates. The link 35 is connected to the arm 33 to connect the weft insertion pump 12 with the cam lever 30.

The link 35 is pivotally connected to the connector 28 for connecting to the weft insertion pump 12 via a connecting pin 36 that is provided on one end of the link 35. The link 35 is pivotally connected to the arm 33 via a connecting pin 37 that is provided on the other end of the link 35. The weft insertion pump 12 is connected to the cam unit 15 via the link 35. The link 35 is pivotally rotatable with respect to the cam lever 30 and the connector 28. The cam lever 30 is connected to the connector 28 via the link 35, so that the rotation of the cam lever 30 is converted to the reciprocal movement of the plunger 25 of the weft insertion pump 12.

The frame (not shown in the drawing) of the water jet loom has a stop 38 to regulate the moving range in the reciprocal direction of the plunger 25 provided in the weft insertion pump 12. The stop 38 is provided at a position in such a manner to face the distal end of the arm 33 of the cam lever 30. The stop 38 has an adjuster 39 that is contactable with the cam lever 30. The rotational range of the cam lever 30 is regulated by adjusting the moving distance of the adjuster 39 in the forward and backward directions. Accordingly, the moving range of the plunger 25 in the reciprocal direction of the plunger 25 is regulated by the rotational range of the cam lever 30 in the reciprocal direction of the cam lever 30.

In the present embodiment, the water injection apparatus 10 includes an auxiliary water supply unit 40 that is provided separately from the weft insertion pump 12 and supplies water to the suction pipe 14. The auxiliary water supply unit 40 includes an auxiliary water supply pipe 41 and a valve 42 provided in the auxiliary water supply pipe 41. The valve 42 opens and closes manually. One end of the auxiliary water supply pipe 41 is connected to the suction pipe 14. The other end of the auxiliary water supply pipe 41 is connected to a tap water supply source 43 that serves as an auxiliary water supply source. The inner diameter of the auxiliary water supply pipe 41 is set to be half of the inner diameter of the suction pipe 14. The tap water supply source 43 can supply tap water having water pressure of 1.8 kg/cm$^2$ to the auxiliary water supply pipe 41.

The valve 42 can flow tap water from the tap water supply source 43 into the auxiliary water supply pipe 41 and shut off the flow of tap water from the tap water supply source 43. In the present embodiment, the valve 42 constantly opens when the water jet loom operates and water flowing through the auxiliary water supply pipe 41 is supplied into the suction pipe 14. When the water jet loom stops, the valve 42 shuts off. That is, the auxiliary water supply pipe 41 serves as an auxiliary water supply passage to continuously supply tap water from the tap water supply source 43 into the suction pipe 14 when the water jet loom operates.

The following will describe the function of the water injection apparatus 10 according to the present embodiment. As the cam 29 rotates at a constant angular speed in synchronization with the operation of the water jet loom, the cam lever 30 is pivotally rotatable about the rotary shaft 34 cooperating with the cam 29, the cam follower 31, and the coil spring 26. When the cam 29 rotates and then the arm 33 of the cam lever 30 is pivotally rotated in the direction away from the weft insertion pump 12, the plunger 25 moves in the forward direction against the urging force of the coil spring 26.

As the plunger 25 moves in the forward direction, the coil spring 26 is compressed. When the plunger 25 moves in the forward direction, a predetermined amount of water is introduced from the water storage tank 13 into the water storage chamber 19 of the weft insertion pump 12 through the suction pipe 14. While the plunger 25 moves in the forward direction so that water is introduced, the check valve 20 on the side of the suction port 17 opens and the check valve 21 on the side of the discharge port 18 closes. Accordingly, no water in the discharge pipe 23 flows reversely toward the water storage chamber 19. As the plunger 25 moves in the forward direction, the urging force of the coil spring 26 increases.

When the cam 29 rotates and then the cam follower 31 passes through the maximum diameter position of the cam 29, the cam follower 31 comes out of contact with the cam 29. Since the plunger 25 receives the urging force of the coil spring 26 that is accumulated by the compression of the coil spring 26, when the cam follower 31 comes out of contact with the cam 29, the plunger 25 moves in the backward direction by the urging force of the coil spring 26, so that the plunger 25 moves to the start point where the plunger 25 starts to move in the forward direction.

When the plunger 25 moves in the backward direction, water in the water storage chamber 19 is pressurized. When water in the water storage chamber 19 is pressurized by the plunger 25, the check valve 21 on the side of the discharge port 18 opens and then the pressurized water in the water storage chamber 19 is pumped through the discharge pipe 23 into the weft insertion nozzle 11. When the plunger 25 moves in the backward direction, the check valve 20 on the side of the suction port 17 closes, so that no water in the water storage chamber 19 flows reversely into the suction pipe 14.

The weft insertion nozzle 11 injects water pumped from the weft insertion pump 12 into the weft insertion nozzle 11 so that a weft yarn Y is inserted into a warp shed by the injection water. When the cam follower 31 being out of contact with the cam 29 comes in contact with the cam 29 or the cam lever 30 comes in contact with the stop 38, one cycle of water injection ends. As shown in FIG. 1, the position of the cam lever 30 when the plunger 25 of the weft insertion pump 12 completes moving in the forward direction is denoted by the solid line. The position of the cam lever 30 when the plunger 25 of the weft insertion pump 12 completes moving in the backward direction is denoted by the two-dotted chain line.

In the present embodiment, while the water jet loom operates, the valve 42 opens. Tap water is supplied from the tap water supply source 43 through the auxiliary water supply pipe 41 into the suction pipe 14. That is, while the water jet loom operates, tap water is continuously supplied into the suction pipe 14 by the auxiliary water supply unit 40.

Figure 2A:
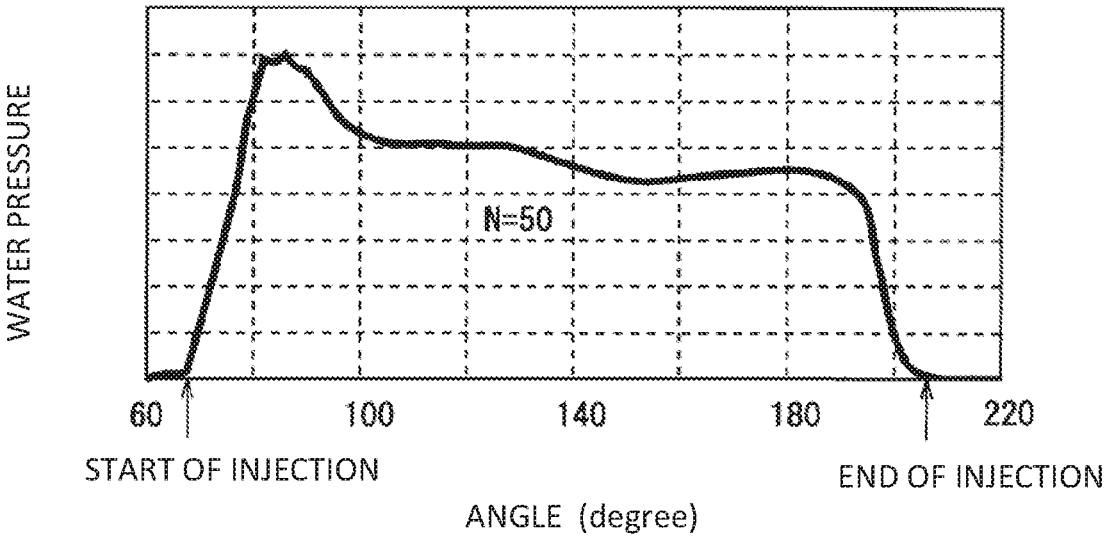
FIG. 2A is a graph showing the relationship between the injection timing and water pressure of injection water in the water injection apparatus of FIG. 1.
Figure 2B:
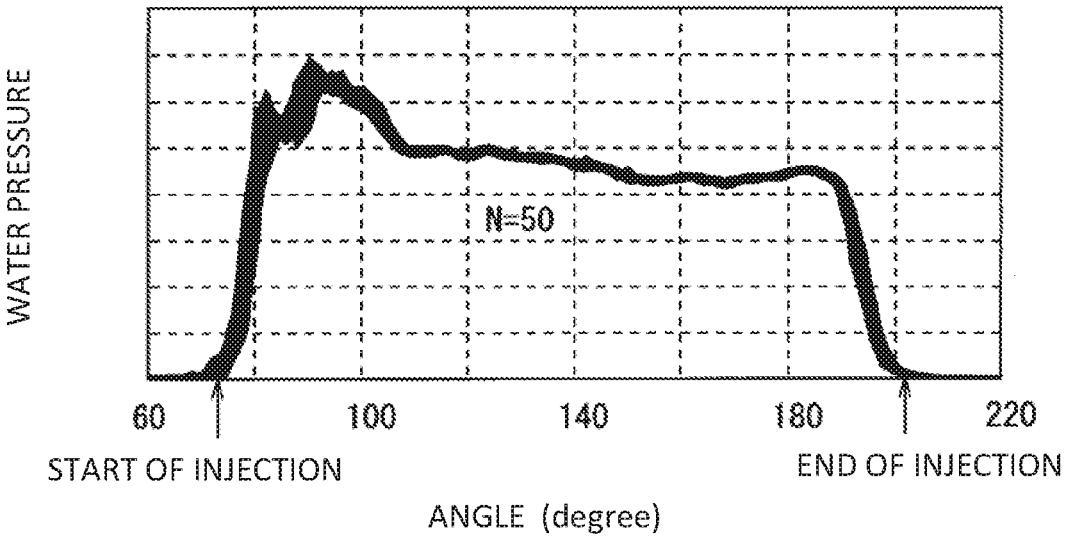
FIG. 2B is a graph showing the relationship between the injection timing and water pressure of injection water in a water injection apparatus as a comparative example.

FIG. 2A is a graph showing the relationship between the injection timing and the water pressure of the discharged water in the water jet loom according to the present embodiment. FIG. 2B is a graph showing the relationship between the injection timing and the water pressure of the discharged water in a water jet loom as a comparative example. In each graph, the water pressure is measured a predetermined weft insertion number of times (50 picks, N=50) in the water jet loom operating at a predetermined rotational speed (high rotation of 1000 rpm or more). Noise is measured in the vicinity of the weft insertion pump 12 (at a position within 1 m of the weft insertion pump 12) with a measurement period of 10 seconds. The water pressure is measured by the pressure sensor 24 provided in the discharge pipe 23.

As shown in FIG. 2A, since tap water is supplied by the auxiliary water supply unit 40, the injection starts earlier as compared to in the comparative example, and the injection ends later as compared to in the comparative example. That is, in the present embodiment, the amount of the injected water is larger than that in the comparative example. Since tap water is supplied to the water storage chamber 19 by the auxiliary water supply unit 40 at the time of sucking water, generation of air bubbles is suppressed. Since generation of air bubbles is suppressed, disappearance of air bubbles at the time of discharging water decreases, so that large noise generated at the time of bubble collapse decreases. That is, generation of cavitation in the weft insertion pump 12 during a high-speed operation is suppressed and noise decreases. It is noted that noise of approximately 101 dB generates in the conventional water injection apparatus, but the noise decreases to approximately 97 dB in the water injection apparatus 10 according to the present embodiment.

In the present embodiment, the generation of cavitation in the weft insertion pump 12 is suppressed, so that the change of the water pressure of the discharged water during weft insertion is stabilized as compared to the comparative example as shown in FIG. 2A. The shape of the graph obtained by the measurement from the first time to the 50th time hardly changes. As the water pressure during weft insertion stabilizes, the weft traveling stabilizes and the weaving quality improves. In the comparative example, the water pressure of the water discharged during weft insertion has a large variation due to the generation of cavitation. As a result, as shown in FIG. 2B, since the measurement result at each number of times does not stabilize, the graph shows the wider width of the water pressure than that in FIG. 2A. Thus, when the water jet loom operates at a high rotational speed, noise of the weft insertion pump 12 at the weaving operation decreases and weft insertion is stably performed.

The water injection apparatus 10 according to the present embodiment has the following advantageous effects.

(1) At least when the weft insertion pump 12 sucks water, the auxiliary water supply unit 40 supplies water to the suction pipe 14, so that the generation of cavitation in the weft insertion pump 12 is suppressed. By suppressing the generation of cavitation in the weft insertion pump 12, variations in the pressure of the injection water are suppressed and noise during a weaving operation can decrease as compared to the conventional water injection apparatus.

(2) Since the auxiliary water supply unit 40 continuously supplies water to the water supply pipe during the operation of the water jet loom, the generation of cavitation in the weft insertion pump 12 is further suppressed. The injection start timing of the injection water becomes earlier and the injection time of the injection water becomes longer as compared to the conventional water injection apparatus. As a result, the amount of the injection water increases, and a weft yarn can travel stably with further reduction of noise.

(3) Since the auxiliary water supply unit 40 is connected to the tap water supply source 43, water can be supplied to the suction pipe 14 with a simple configuration. The auxiliary water supply unit 40 includes the valve 42, so that the supply of water from the auxiliary water supply unit 40 can stop while the operation of the water jet loom stops. As a result, unnecessary water consumption can be prevented while the operation of the water jet loom stops.

Second Embodiment

The following will describe a water injection apparatus according to a second embodiment. The second embodiment is different from the first embodiment in the configuration of the auxiliary water supply unit. The reference numerals of the first embodiment denote elements of the second embodiment which are common to or similar to those of the first embodiment and the description is omitted.

Figure 3:
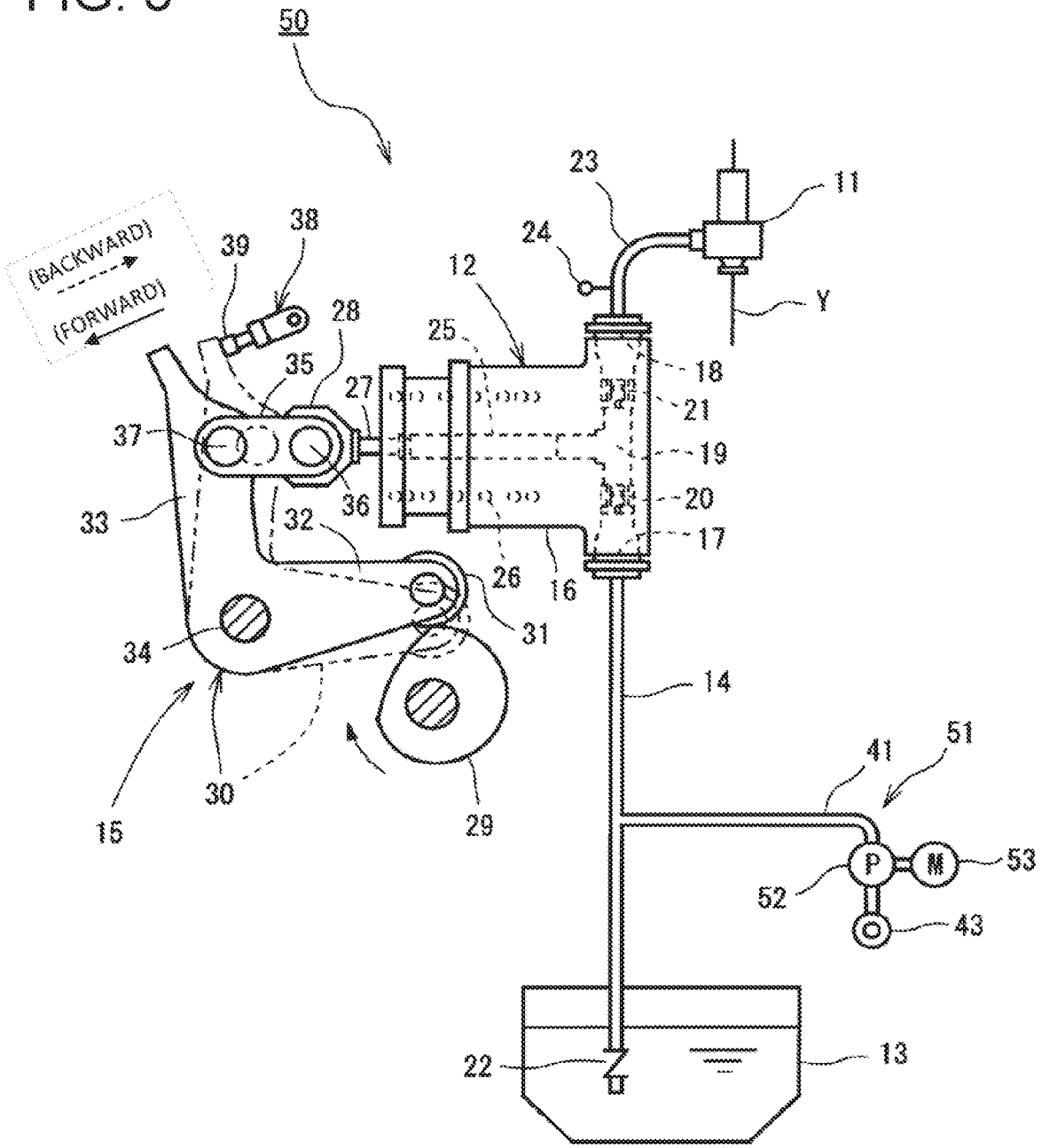
FIG. 3 is a schematic view showing a water injection apparatus for a water jet loom, according to a second embodiment of the present disclosure.

As shown in FIG. 3, an auxiliary water supply unit 51 of the water injection apparatus 50 of the water jet loom, includes an auxiliary water supply pump 52 that supplies water to the suction pipe 14. The auxiliary water supply pump 52 is driven by an electric motor 53 for driving the pump. The electric motor 53 is controlled by a control device (not shown in the drawing). In the present embodiment, the auxiliary water supply pump 52 can adjust the water supply amount and the water pressure of tap water supplied into the suction pipe 14. The auxiliary water supply unit 51 can appropriately supply water to the suction pipe 14.

Third Embodiment

The following will describe a water injection apparatus according to a third embodiment. The third embodiment is different from the first embodiment in the configuration of the auxiliary water supply unit. The reference numerals of the first embodiment denote elements of the third embodiment which are common to or similar to those of the first embodiment and the description is omitted.

Figure 4:
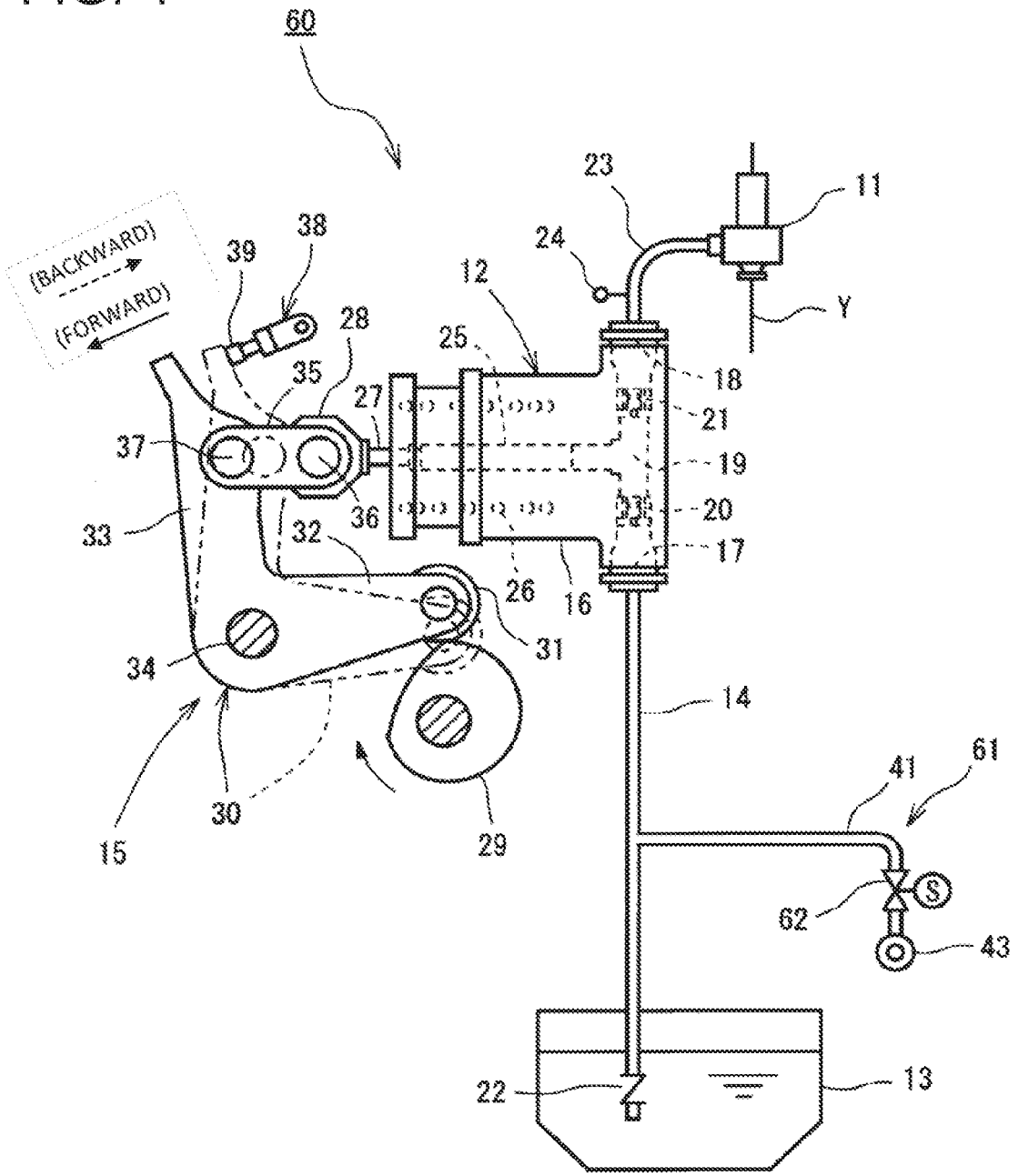
FIG. 4 is a schematic view showing a water injection apparatus for a water jet loom, according to a third embodiment of the present disclosure.
Figure 5:
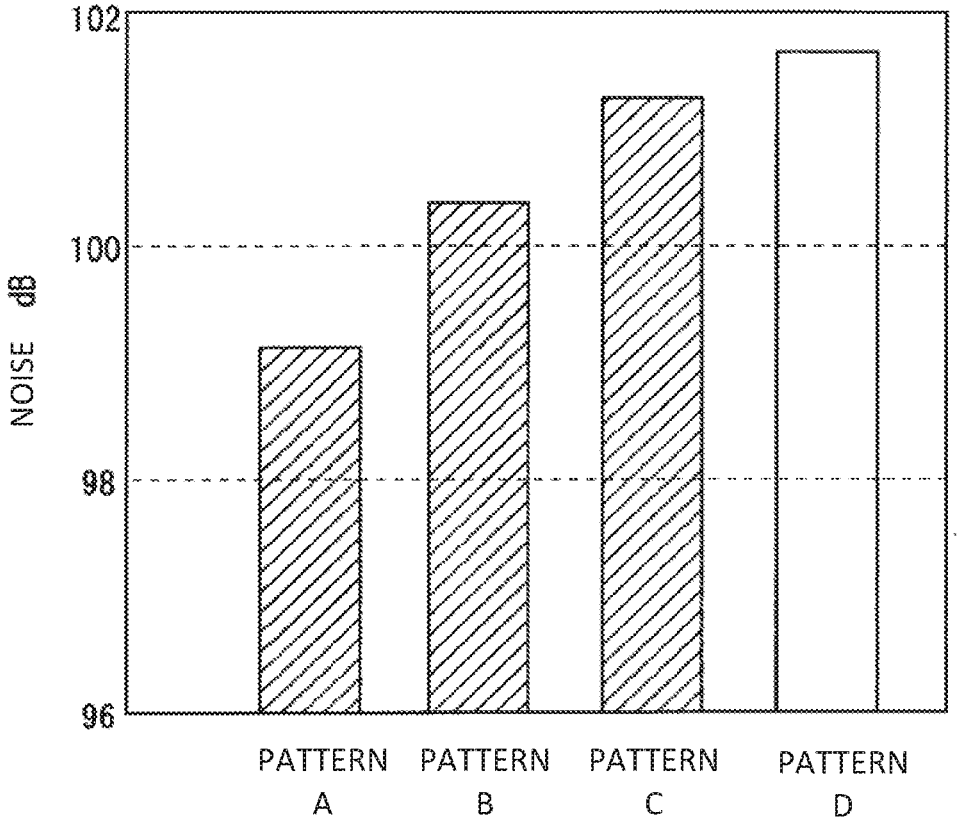
FIG. 5 is a graph showing the result of four patterns of noise measurement in opening and closing of an electromagnetic valve.

As shown in FIG. 4, an auxiliary water supply unit 61 of a water injection apparatus 60 of the water jet loom, includes an electromagnetic valve 62. The electromagnetic valve 62 is controlled based on a command from a control device (not shown in the drawing). Thus, the timing to open and close the electromagnetic valve 62 can be changed. For example, the electromagnetic valve 62 can open and close in accordance with the operation of the weft insertion pump 12. In the present embodiment, as shown in FIG. 5, four patterns A, B, C, and D to open and close the electromagnetic valve 62 are set. Noise is measured in each of the patterns A to D.

In the pattern A, the electromagnetic valve 62 constantly opens and tap water is continuously supplied to the suction pipe 14 by the auxiliary water supply unit 61. In the pattern B, the period to open the electromagnetic valve 62 is set at 20 degrees to 250 degrees in one rotation of the spindle and tap water is supplied to the suction pipe 14 by the auxiliary water supply unit 61 in the period. In the pattern C, the period to open the electromagnetic valve 62 is set at 80 degrees to 250 degrees in one rotation of the spindle and tap water is supplied to the suction pipe 14 by the auxiliary water supply unit 61 in the period. In the pattern D, no water is supplied to the suction pipe 14 by the auxiliary water supply unit 61 without opening the electromagnetic valve 62.

As shown in FIG. 5, in the pattern A, the noise is most reduced. Since tap water is continuously supplied to the suction pipe 14 by the auxiliary water supply unit 61, the highest noise reduction effect is obtained. The effect is substantially the same as the noise reduction effect in the first embodiment. In the pattern B, the noise reduction effect is high next to the pattern A. In the pattern C, the noise reduction effect is high next to the pattern B. In the patterns A to C, water is supplied to the suction pipe 14 at least when the weft insertion pump 12 sucks water, so that the amount of the injection water increases. In the pattern D, as in the comparative example in the first embodiment, the noise reduction effect is not obtained.

Thus, the measurement results of the noises in the patterns A to D show that in the patterns A to C, the amount of the injection water increases, so that the noise of the weft insertion pump 12 decreases. Accordingly, by changing the timing to open and close the electromagnetic valve 62 as in the present embodiment, at least when the weft insertion pump 12 sucks water, the water is supplied to the suction pipe 14, so that the noise of the weft insertion pump 12 can decrease.

The present disclosure is not limited to the above-described embodiments, but may be modified variously within the scope of the disclosure, as exemplified below.

In the above embodiments, the auxiliary water supply unit supplies tap water into the water supply pipe, but water supplied into the water supply pipe by the auxiliary water supply unit is not limited to tap water. Water other than tap water may be supplied into the water supply pipe by the auxiliary water supply unit. For example, the auxiliary water supply pump as in the second embodiment may be disposed in the water storage tank 13 and water in the water storage tank 13 may be supplied into the suction pipe 14.

In the first embodiment, the auxiliary water supply unit 40 is provided with the valve and in the third embodiment, the auxiliary water supply unit 61 is provided with the electromagnetic valve 62, but the configuration may be modified. When the water pressure of the tap water supply source 43 is small and the flow rate is small, the auxiliary water supply unit may not include a valve or an electromagnetic valve. In the case, since the auxiliary water supply unit need not necessarily have a valve or an electromagnetic valve, the manufacturing cost of the water injection apparatus can decrease.

In the above embodiments, the water injection apparatus of the water jet loom is provided with the single auxiliary water supply unit, but the configuration may be modified. For example, water injection apparatuses of a plurality of water jet looms may use a single auxiliary water supply unit. Specifically, for example, an auxiliary water supply pipe may be branched in accordance with the number of water jet looms and the branched auxiliary water supply pipe may be connected to the suction pipe of each water jet loom.

What is claimed is:

1. A water injection apparatus for a water jet loom, comprising:

a weft insertion nozzle for weft insertion of a weft yarn by injection water;

a weft insertion pump pumping water into the weft insertion nozzle;

a water storage tank storing water introduced into the weft insertion pump; and a suction pipe passing water from the water storage tank into the weft insertion pump, wherein the water injection apparatus includes an auxiliary water supply unit that is provided separately from the weft insertion pump, the auxiliary water supply unit including an auxiliary water supply pipe having one end that is connected to the suction pipe and another end that is connected to an auxiliary water supply source, the auxiliary water supply unit supplying water to the suction pipe at least when the weft insertion pump sucks water, wherein the one end of the auxiliary water supply pipe is connected to a portion of the suction pipe located between the water storage tank into the weft insertion pump.

2. The water injection apparatus for the water jet loom, according to claim 1, wherein the auxiliary water supply unit continuously supplies water to the suction pipe during operation of the water jet loom.

3. The water injection apparatus for the water jet loom, according to claim 1, wherein the auxiliary water supply unit includes a valve that is connected to a tap water supply source and shuts off flow of tap water from the tap water supply source.

4. The water injection apparatus for the water jet loom, according to claim 1, wherein the auxiliary water supply unit includes an auxiliary water supply pump that supplies water to the suction pipe.

* * * * *